United States Patent [19]

Stransky

[11] Patent Number: 4,708,668

[45] Date of Patent: Nov. 24, 1987

[54] PROCESS OF MANUFACTURING AN IMPROVED ELECTRICAL CONNECTOR AND PRODUCT THEREOF

[76] Inventor: Le Roy V. Stransky, 425 Covington Rd., Los Altos, Calif. 94022

[21] Appl. No.: 840,017

[22] Filed: Mar. 17, 1986

[51] Int. Cl.[4] ..... H01R 13/05

[52] U.S. Cl. ..... 439/825; 439/816

[58] Field of Search ..... 339/252 P, 255 R, 255 A, 339/259 R, 259 F, 278 T; 29/874, 878

[56] References Cited

U.S. PATENT DOCUMENTS

| | | | |
|---|---|---|---|
| 2,502,634 | 4/1950 | Smith | 339/252 P |
| 3,031,641 | 4/1962 | Camzi | 339/252 P |
| 3,853,377 | 12/1974 | Shlesinger, Jr. | 339/255 R |
| 3,871,737 | 3/1975 | Dorrell et al. | 339/255 R |

FOREIGN PATENT DOCUMENTS

| | | | |
|---|---|---|---|
| 670788 | 1/1939 | Fed. Rep. of Germany | 339/252 P |
| 2832432 | 2/1980 | Fed. Rep. of Germany | 339/252 P |
| 1288813 | 2/1962 | France | 339/252 S |
| 739472 | 10/1955 | United Kingdom . | |
| 929674 | 6/1963 | United Kingdom . | |

*Primary Examiner*—Joseph H. McGlynn
*Assistant Examiner*—Daniel W. Howell
*Attorney, Agent, or Firm*—Alfons Puishes

[57] ABSTRACT

The method of manufacture of an electrical connector and the connector produced thereby employing slotted connecting cylindrical prongs with a pre-vulcanized elastomeric insert is made possible by stretching a strip of elastomeric material until it reaches a thickness of half that of the slots, inserting it in the slots and permitting it to contract in length and expand in thickness. A special strip of novel construction is adapted for use with an expanding tool to facilitate the operation. The resulting connector having prongs containing pre-stressed inserts and consequently possessing improved connecting properties is achieved.

6 Claims, 11 Drawing Figures

PROCESS OF MANUFACTURING AN IMPROVED ELECTRICAL CONNECTOR AND PRODUCT THEREOF

BACKGROUND OF THE INVENTION

Electrical connectors of the plug-in type which utilize elastomeric material inserted in the connector to improve contact and longevity of the connector are well known in the art. These utilize various geometries and methods of insertion of the elastomeric material as set forth in the prior art known to inventor below.

Smith, U.S. Pat. No. 2,502,634 teaches the use of cylindrical shaped resilient material in connection with a split core of the female member to improve the contact with the male.

Camzi, U.S. Pat. No. 3,031,641 is likewise directed to improvements in the female member of the connector by utilizing a special slotted hollow construction to provide elastic action of the metallic members.

Dorell, U.S. Pat. No. 3,871,737 utilizes a conductive elastomeric material in a housing to which the male member is inserted, the material being displaced by the insertion to surround the male member and provide improved contact.

Schlesinger, U.S. Pat. No. 3,853,377 teaches several applications of an elastomeric material both internal to the male member and external to the female member and is especially adapted for electrical panel boards and the method of introduction of the elastomeric material is such as to preclude its expansion under pressure which is a difficulty which I overcome using my method of manufacture.

British Pat. No. 739,472 comes close to mine in that it teaches a cylindrical shaped rubber insert between two connecting limbs in such a manner as to provide opportunity for the rubber to expand when under pressure while improving the contact of the limbs. It is, however, limited to the particular cylindrical geometry of the overall plug connector.

British Pat. No. 929,674 teaches the use of a nylon insert which is split into sections, the resilience of which tends to aid retention of the inserting pin. The insert in this case is likewise confined so as to limit its expansive opportunities and hence its flexibility. It is likewise limited to the geometry which it teaches which is far different than that of mine.

Plugs comprising cylindrical prongs split through the center as illustrated herein have many advantages but the insertion of an elastomeric material in the slots to increase the efficiency has met with difficulties and has not been effected properly until the invention of my process as covered herein.

All previous devices using an elastomer to prevent deformation and improve contact require vulcanizing the elastomer after insertion necessitating expensive and time consuming moulding plus expensive placement of the inserts.

Should there be other than a secure tight connection when used electrically under load, the loose connection can be cause for internal arcing between the two loose surfaces. This causes less so called good conducting contact until the area spreads to such an extent that the metal reaches temperatures high enough to anneal the metal and causes further oxidation on the surface.

If copper is present, such as in brass, the oxide formed is copper oxide, which is a rectifier, causing more heating and deteriorating of the surfaces through resisting the passage of the current. The units covered with this oxide should not be scraped, because if this is scraped off after it has cooled down an even looser fit will result starting the cycle all over.

Causes of lessing of electrical contact area are:

Repeated improper making and breaking contact where the connector is severely "wriggled" to open the connection, making and breaking under load, etc., dropping or stepping on the male connector, hitting the pin, contamination through paints, dirt, etc. Using a knife blade to open up the compressed slot has been considered acceptable where light loads are used. Constant uses can eventually cause the side of a pin to break off. Considering time, material and effort, plus down time, it gets to be a pretty expensive detail.

SUMMARY OF THE INVENTION

I have discovered that by use of the process of my invention I can successfully and effectively insert a pre-vulcanized and custom color coded elastomeric strip in the slots of the prongs of my plug to produce the desired increase in efficiency of the latter and avoid the above problems. I utilize a flat strip of material having a thickness of about twice that of the slots in the plug, stretching it to about twice its length, thereby decreasing its thickness by about fifty percent, inserting it in the slot and allowing it to contract to effect a tight fit. I may use a special strip which is cylindrically shaped along its edges and then using a special tool to facilitate the stretching and relaxing of the strip.

The device so produced provides a snug fit, the elastomer exerting a constant pressure against the prongs.

DESCRIPTION OF A PREFERRED EMBODIMENT

Figure 1:
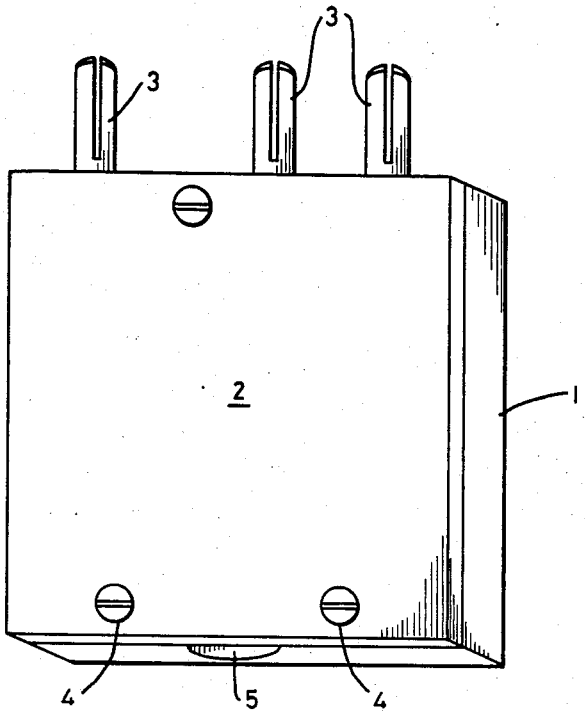
FIG. 1 is a perspective of a flat connector with cylindrical connecting prongs.
Figure 2:
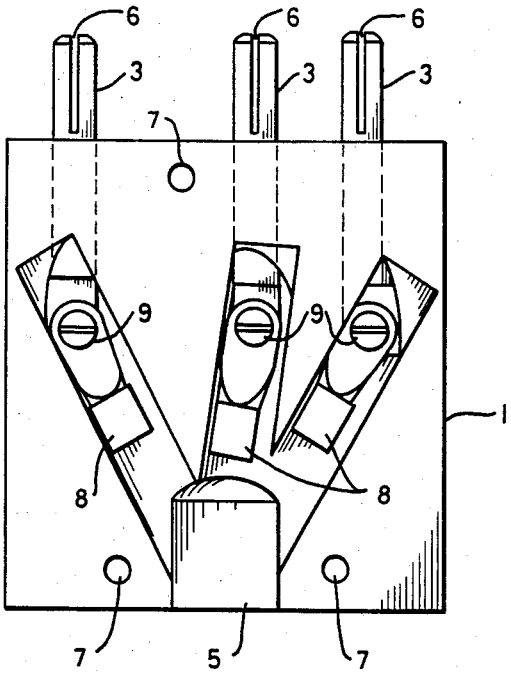
FIG. 2 is the connector of FIG. 1 with its cover plate removed showing internal connections.

Referring now to the figures and particularly to FIG. 1 and FIG. 2, there is seen the housing of the connector 1 having its cover plate 2. The cylindrical prongs or contacting elements are shown at 3 and the fastening screws holding the cover plate 2 in position are shown at 4. The opening for the inlet cable for the power supply is shown at 5.

Figure 3:
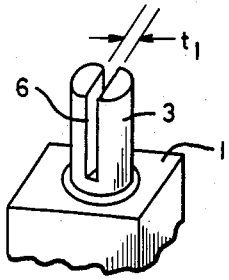
FIG. 3 is an isometric cutaway of one of the prongs used with my invention.

The prongs or connecting elements 3 are split vertically by means of slots 6, better seen on FIG. 3. The screw holes are shown at 7 and the electrical connecting lugs are shown at 8.

In the illustration shown, the connector comprises three prongs, one of which is utilized for a grounding terminal, as is well known to those skilled in the art. My invention, of course, may be applied to connectors having one to any number of prongs.

Figures 4A, 4B:
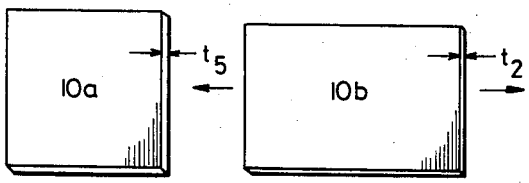
FIG. 4A shows an elastomeric strip prior to its insertion of the slot in the plug.
FIG. 4B shows the strip of 4A in stretched condition for insertion into the prong.

Referring now to FIG. 3, the thickness of slots 7 in prong 3 is shown as $t_i$. Referring to FIG. 4A there is seen a strip of elastomeric material 10, having a thickness $t_3$ which may be slightly thicker than the thickness of slots 6 of FIG. 3.

Referring to FIG. 4B there is seen the same strip 10 in a stretched condition until its thickness reaches the value of $t_2$ which is somewhat less than the value of $t_1$. While in a stretched condition the strip 10 is inserted into slot 3 as shown on FIG. 5 and then the tension released so that strip 10 completely fills slot 6 and remains in a pre-stressed condition.

Figure 6:
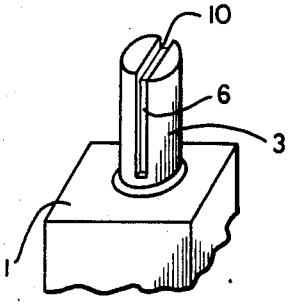
FIG. 6 shows the plug of FIG. 3 after the removal of the surplus material.

Prong 3 is then compressed a predetermined amount in a vise or similar device causing further compressions and extrusion of strip 10 and while so compressed the protruding ends are cut off, the compression of prongs 3 is released and the insert 10 retracts somewhat to its final dimensions as shown in FIG. 6.

For my elastomeric material I have found that a pre-vulcanized elastomer of the fluro-carbon variety is specially compounded and having a heat resistance of 400 to 600 degrees Fahrenheit, a durometer value of 20 to 60 and a stretchability of 300% to 700% to be the most satisfactory depending upon the application. Other similar material may be used.

Insofar as the slot dimensions are concerned I have found that for a 60 ampere plug, having the slot thickness of $t_1$ of 0.020 inches and elastomer thickness initially $t_3$ of 0.032 inches is most satisfactory. I may employ also any suitable adhesive preferably of the silicone class between the elastomer 10 and slot 6.

Figure 7:
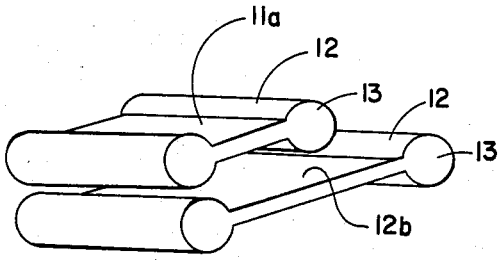
FIG. 7 is an isometric of the elastomeric strip having cylindrical edges forming knobs in original form and after partial stretching.

Referring now to FIG. 7 there is seen a special embodiment of strip 11a having cylindrical edges 12 which in cross-section form knobs 13. The partially stretched strip **11*b* is illustrated at 12*b***.

Figure 8:
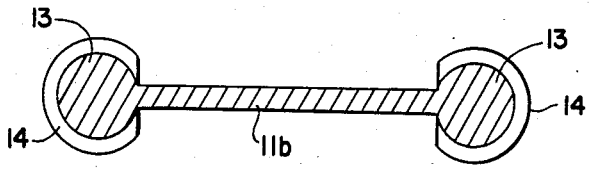
FIG. 8 is a cross-section of the strip showing its edges being grasped by the retainers of my expanding tool.
Figure 9:
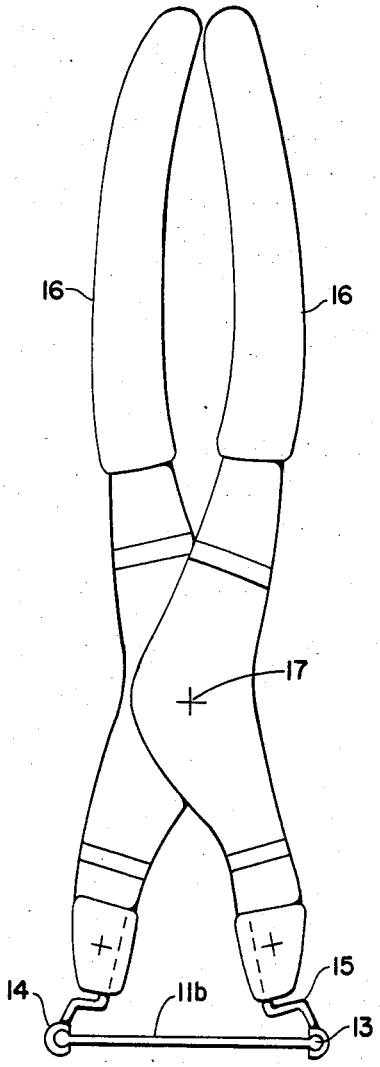
FIG. 9 shows the strip in stretched condition by my tool
Figure 10:
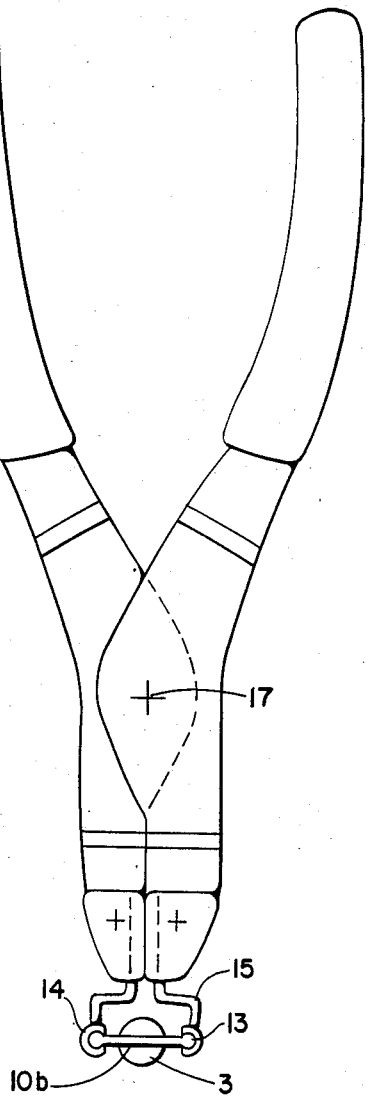
FIG. 10 shows the strip inserted in the slot by my tool.

In FIG. 8 there is seen strip **11*b* in cross-section and knobs gripped by retainers 14 which form a part of my special stretching tool shown in FIGS. 9 and 10**.

FIG. 9 shows the strip **11*b* in stretched condition by operation of my special tool. The latter is basically a pair of commercial wire strippers in which the jaws spread open on closing of the grips on which are welded the retainers 14 by means of brackets 15. Operation of the handles 16 about the pivot 17 effects the stretching of the strip 11*b***.

Figure 5:
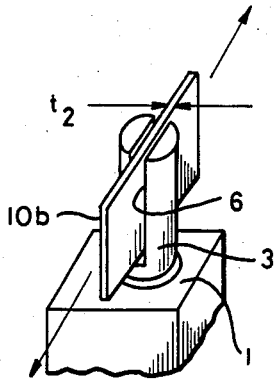
FIG. 5 shows the strip of FIG. 4A immediately after insertion.

FIG. 10 shows the strip in released condition corresponding to the condition shown on FIG. 5 inserted in prong 3.

As thus produced, the pre-vulcanized elastomer in the connector is in a pre-stressed condition in the slots of the prongs which adds to its tightness within the slots while at the same time exerting a constant pressure within the slots to effect better and more reliable contact of the prongs while not protruding beyond their surface. (FIG. 6)

I submit that no such electrical connector has been produced heretofore, since no process for making such was known until developed by me as described herein.

I claim:

1. The process of inserting a pre-vulcanized elastomeric strip in the longitudinal slot of a cylindrical prong of an electrical connector comprising the steps:

selecting a strip having a thickness of approximately twice that of the width of said slot;

stretching said strip to approximately twice its original length so that its thickness becomes slightly less than that of the width of said slot;

inserting said strip as so stretched in said slot;

releasing the tension on said strip;

permitting said strip to expand in thickness and fill said slot;

cutting off parts of said strip protruding beyond the outside of said prong.

2. The steps of claim 1 including the additional step of compressing said prong before cutting off said protruding parts releasing said compression and permitting said strip to withdraw within said slot while in a pre-stressed condition.

3. The steps of claim 1 in which said originally selected strip is equipped with longitudinal edges having a generally cylindrical cross-section:

gripping said edges in a pair of retaining rings positioned at the ends of the jaws of a tool having spreader jaws equipped with handles in operational connection with said jaws and disposed to open when said handles are closed;

closing said handles and spreading said jaws thereby stretching said strip;

inserting said strip while so stretched into said slot;

releasing said handles and permitting said strip to contract in length and expand in thickness thereby filling said slot;

removing said tool and cutting off parts of said strip protruding beyond the outside of said prong.

4. The steps of claim 3 including the additional step of compressing said prongs before cutting off said protruding parts, releasing said compression and permitting said strip to withdraw within said slot.

5. The step of claim 2 or claim 4 including the additional step of the addition of an ahesive material to said elastomer before inserting into said slot.

6. an improved electrical connector having cylindrical terminal prongs, said prongs having a diametrical slot therethrough extending along most of the length thus defining two symmetrical elements in each of said prongs and further comprising:

an insert of heat-resisting pre-vulcanized resilient elastomeric material inserted in said slots while said material is under tension;

an adhesive material inserted between the interior surface of said slots and said elastomeric material;

said elastomeric material remaining in a pre-stressed condition while inserted in said slots;

whereby said material exerts a constant pressure upon said elements;

thereby producing improved contact by said prongs.

* * * * *